US007713363B2

(12) United States Patent
Sano et al.

(10) Patent No.: US 7,713,363 B2
(45) Date of Patent: May 11, 2010

(54) METHOD OF MANUFACTURING HIGH-STRENGTH ALUMINUM ALLOY EXTRUDED PRODUCT EXCELLING IN CORROSION RESISTANCE AND STRESS CORROSION CRACKING RESISTANCE

(75) Inventors: Hideo Sano, Nagoya (JP); Shinichi Matsuda, Nagoya (JP); Yasushi Kita, Nagoya (JP)

(73) Assignee: Sumitomo Light Metal Industries, Ltd., Tokyo (JP)

( * ) Notice: Subject to any disclaimer, the term of this patent is extended or adjusted under 35 U.S.C. 154(b) by 373 days.

(21) Appl. No.: 10/666,216

(22) Filed: Sep. 18, 2003

(65) Prior Publication Data

US 2004/0084119 A1 May 6, 2004

(30) Foreign Application Priority Data

Nov. 1, 2002 (JP) ..... 2002-319453

(51) Int. Cl.
*C22F 1/04* (2006.01)

(52) U.S. Cl. ..... 148/689

(58) Field of Classification Search ..... 148/689
See application file for complete search history.

(56) References Cited

U.S. PATENT DOCUMENTS 5,503,690 A * 4/1996 Wade et al. ..... 148/550
6,364,969 B1 * 4/2002 Couper ..... 148/415

FOREIGN PATENT DOCUMENTS

JP 04000353 A * 1/1992
JP 07041897 A * 2/1995
JP 2001205329 A * 7/2001
JP 2002317255 A * 10/2002

* cited by examiner

*Primary Examiner*—Roy King
*Assistant Examiner*—Jie Yang
(74) *Attorney, Agent, or Firm*—Flynn, Thiel, Boutell & Tanis, P.C.

(57) ABSTRACT

A method of manufacturing a high-strength aluminum alloy extruded product which excels in corrosion resistance and stress corrosion cracking resistance, and is suitably used in applications as structural materials for transportation equipment such as automobiles, railroad carriages, and aircrafts. The method includes extruding a billet of an aluminum alloy containing 0.5% to 1.5% of Si, 0.9% to 1.6% of Mg, 0.8% to 2.5% of Cu, while satisfying the following equations (1), (2), (3), and (4), $$3 \leqq Si\% + Mg\% + Cu\% \leqq 4 \quad (1)$$

$$Mg\% \leqq 1.7 \times Si\% \quad (2)$$

$$Mg\% + Si\% \leqq 2.7 \quad (3)$$

$$Cu\%/2 \leqq Mg\% \leqq (Cu\%/2) + 0.6 \quad (4)$$

and further containing 0.5% to 1.2% of Mn, with the balance being Al and unavoidable impurities, into a solid product by using a solid die, or into a hollow product by using a porthole die or a bridge die, thereby obtaining the solid product or the hollow product in which a fibrous structure accounts for 60% or more of an area-fraction of the cross-sectional structure of the product.

5 Claims, 5 Drawing Sheets

METHOD OF MANUFACTURING HIGH-STRENGTH ALUMINUM ALLOY EXTRUDED PRODUCT EXCELLING IN CORROSION RESISTANCE AND STRESS CORROSION CRACKING RESISTANCE

BACKGROUND OF THE INVENTION

1. Field of the Invention

The present invention relates to a method of manufacturing a high-strength aluminum alloy extruded product excelling in corrosion resistance and stress corrosion cracking resistance. More particularly, the present invention relates to a method of manufacturing a high-strength aluminum alloy extruded product excelling in corrosion resistance and stress corrosion cracking resistance which is suitable in application as structural materials for transportation equipment such as automobiles, railroad carriages, and aircrafts.

2. Description of Background Art

In recent years, emission regulations have been tightened from the viewpoint of protection of the global environment. In the field of manufacture of structural members and components for transportation equipment such as automobiles, the reduction of vehicle weight has been vigorously pursued to save fuel consumption and hence to decrease the emission of carbon dioxide and other noxious gases. An effective means to reduce the vehicle weight is the use of aluminous materials instead of conventionally used ferrous materials.

The 6000 series (Al—Mg—Si) aluminum alloys as represented by an AA6061 alloy and AA6063 alloy are widely employed in practical applications in transportation equipment components due to excellent workability, easiness of production, and excellent corrosion resistance. However, since the 6000 series alloys have disadvantages in strength in comparison with high-strength aluminum alloys such as the 7000 series (Al—Zn—Mg) alloys and the 2000 series (Al—Cu) alloys, an increase in the strength of the 6000 series aluminum alloys has been attempted. For example, an AA6013 alloy, AA6056 alloy, AA6082 alloy, and the like have been developed.

These alloys possess improved strength in comparison with the conventional AA6061 alloy or the like. However, further progress in the reduction of the vehicle weight is making requirements for thinner and lighter materials even more demanding. Since there still have been cases where the above alloys are not wholly satisfactory in terms of strength, corrosion resistance, and stress corrosion cracking resistance, there is proposed an aluminum alloy comprising 0.5 to 1.5% of Si, 0.9 to 1.5% of Mg, 1.2 to 2.4% of Cu, wherein the composition of Si, Mg, and Cu satisfies the conditional equations $3 \leqq Si\% + Mn\% + Cu\% \leqq 4$, $Mg \leqq 1.7 \times Si\%$, and $Cu\%/2 \leqq Mg\% \leqq (Cu\%/2) + 0.6$, and further comprising 0.2 to 0.4% of Cr, while limiting Mn as an impurity at 0.05% or less, with the balance being Al and unavoidable impurities (Japanese Patent Application Laid-open No. 8-269608).

However, this aluminum alloy is mainly used as a sheet material and has the disadvantage of inferior extrudability and inferior characteristics of extrusions in extrusion application, particularly when extruded into a hollow profile by using a porthole die or a spider die. In order to overcome this problem, one of the inventors of the present invention, together with other inventors, reviewed the above composition and proposed an Al—Cu—Mg—Si alloy extruded product for application in structural members of transportation equipment (Japanese Patent Application Laid-open No. 10-306338). This aluminum alloy extruded product is excellent in extrudability into a hollow profile and is characterized in that, when a tensile test is conducted for the weld joints inside the extruded hollow cross section by applying a tensile stress in the direction perpendicular to the extrusion direction, the aluminum alloy extruded product fractures at locations other than the weld joints.

However, if the above aluminum alloy extruded product is used in a reduced thickness, the aluminum alloy extruded product is not entirely capable of providing the required strength. In order to improve the characteristics of the above Al—Cu—Mg—Si alloy extruded product, one of the inventors of the present invention together with other inventors further proposed to add Mn to the Al—Cu—Mg—Si alloy and to control the thickness of the crystal layer of the Al—Cu—Mg—Si alloy extruded product, thereby providing a high-strength alloy extruded product having excellent corrosion resistance (Japanese Patent Application Laid-open No. 2001-11559). However, this aluminum alloy exhibits poor extrudability in comparison with conventional alloys such as the AA6063 alloy due to high deformation resistance. In particular, when successive billets are supplemented for a continuous extrusion of a solid product, it is necessary to provide a flow guide at the front of the solid die. However, this aluminum alloy suffers from deficiencies such as extrusion cracking occurring at the corners of the extruded product and a tendency for forming a coarse surface grain structure, thereby causing a deterioration in strength as well as in stress corrosion cracking resistance.

Moreover, in the case where a hollow product is extruded by using a porthole die or a bridge die, this aluminum alloy also presents problems such as extrusion cracking and a tendency for forming a coarse grain structure along the joints, thereby causing a deterioration in strength, corrosion resistance, and stress corrosion cracking resistance.

The present invention has been achieved after extensive experiments and investigations conducted in an attempt to solve the above-described problems associated with high-strength aluminum alloy extruded products, including studies concerning the relationship between the characteristics of the extruded product and dimensions of the die as well as various parts of flow guides, applicable when a solid product is extruded using a solid die alone or using a solid die together with a flow guide attached thereto, and studies concerning the relationship between the characteristics of the extruded product and the difference in flow speeds of the aluminum alloy inside the extrusion die, applicable when a hollow product is extruded by using a porthole die or a bridge die. Accordingly, an object of the present invention is to provide a method of manufacturing an aluminum alloy extruded product excelling in corrosion resistance, stress corrosion cracking resistance, and strength, as achieved by effectively preventing the occurrence of extrusion cracking or formation of a coarse grain structure in the extruded product.

SUMMARY OF THE INVENTION

In order to achieve the above object, the present invention provides a method of manufacturing a high-strength aluminum alloy extruded product excelling in corrosion resistance and stress corrosion cracking resistance, the method comprising extruding a billet of an aluminum alloy comprising (hereinafter, all compositional percentages are by weight), 0.5% to 1.5% of Si, 0.9% to 1.6% of Mg, 0.8% to 2.5% of Cu, while satisfying the following equations (1), (2), (3), and (4), $$3 \leqq Si\% + Mg\% + Cu\% \leqq 4 \quad (1)$$

$$Mg\% \leqq 1.7 \times Si\% \quad (2)$$

$$Mg\%+Si\% \leqq 2.7 \quad (3)$$

$$Cu\%/2 \leqq Mg\% \leqq (Cu\%/2)+0.6 \quad (4)$$

and further comprising 0.5% to 1.2% of Mn, with the balance being Al and unavoidable impurities, into a solid product by using a solid die in which a bearing length (L) is 0.5 mm or more and the bearing length (L) and a thickness (T) of the solid product to be extruded have a relationship defined by $L \leqq 5T$, thereby obtaining a solid product in which a fibrous structure accounts for 60% or more in area-fraction of the cross-sectional structure of the solid product.

In this method of manufacturing a high-strength aluminum alloy extruded product excelling in corrosion resistance and stress corrosion cracking resistance, a flow guide may be provided at a front of the solid die, an inner circumferential surface of a guide hole of the flow guide being separated from an outer circumferential surface of an orifice continuous with the bearing of the solid die at a distance of 5 mm or more, and the thickness of the flow guide being 5% to 25% of the diameter of the billet.

The present invention also provides a method of manufacturing a high-strength aluminum alloy extruded product excelling in corrosion resistance and stress corrosion cracking resistance, the method comprising extruding a billet of the above aluminum alloy into a hollow product by using a porthole die or a bridge die in which the ratio of the flow speed of the aluminum alloy in a non-joining section to the flow speed of the aluminum alloy in a joining section in a chamber, where the billet reunites after entering a port section of the die in divided flows and subsequently encircles a mandrel, is controlled at 1.5 or less, thereby obtaining the hollow product in which a fibrous structure accounts for 60% or more in area-fraction of the cross-sectional structure of the hollow product.

In the above method of manufacturing a high-strength aluminum alloy extruded product excelling in corrosion resistance and stress corrosion cracking resistance, the aluminum alloy may further comprise at least one of 0.02% to 0.4% of Cr, 0.03% to 0.2% of Zr, 0.03% to 0.2% of V, and 0.03% to 2.0% of Zn.

In the above method of manufacturing a high-strength aluminum alloy extruded product excelling in corrosion resistance and stress corrosion cracking resistance, the method may comprise a homogenization step wherein a billet of the aluminum alloy is homogenized at 450° C. or more and cooled at an average cooling rate of 25° C./h or more from the homogenization temperature to at least 250° C. an extrusion step wherein the homogenized billet of the aluminum alloy is extruded at a temperature of 450° C. or more, a press quenching step wherein the extruded product is cooled to a temperature of 100° C. or less at a cooling rate of 10° C./sec or more in a state in which a surface temperature of the extruded product immediately after the extrusion is maintained at 450° C. or more, or a quenching step wherein the extruded product is subjected to a solution heat treatment at a temperature of 450° C. or more and cooled to a temperature of 100° C. or less at a cooling rate of 100° C./sec or more, and an aging step wherein the quenched product is heated at a temperature of 150° C. to 200° C. for 2 to 24 hours.

DETAILED DESCRIPTION OF THE PREFERRED EMBODIMENT

Figure 1:
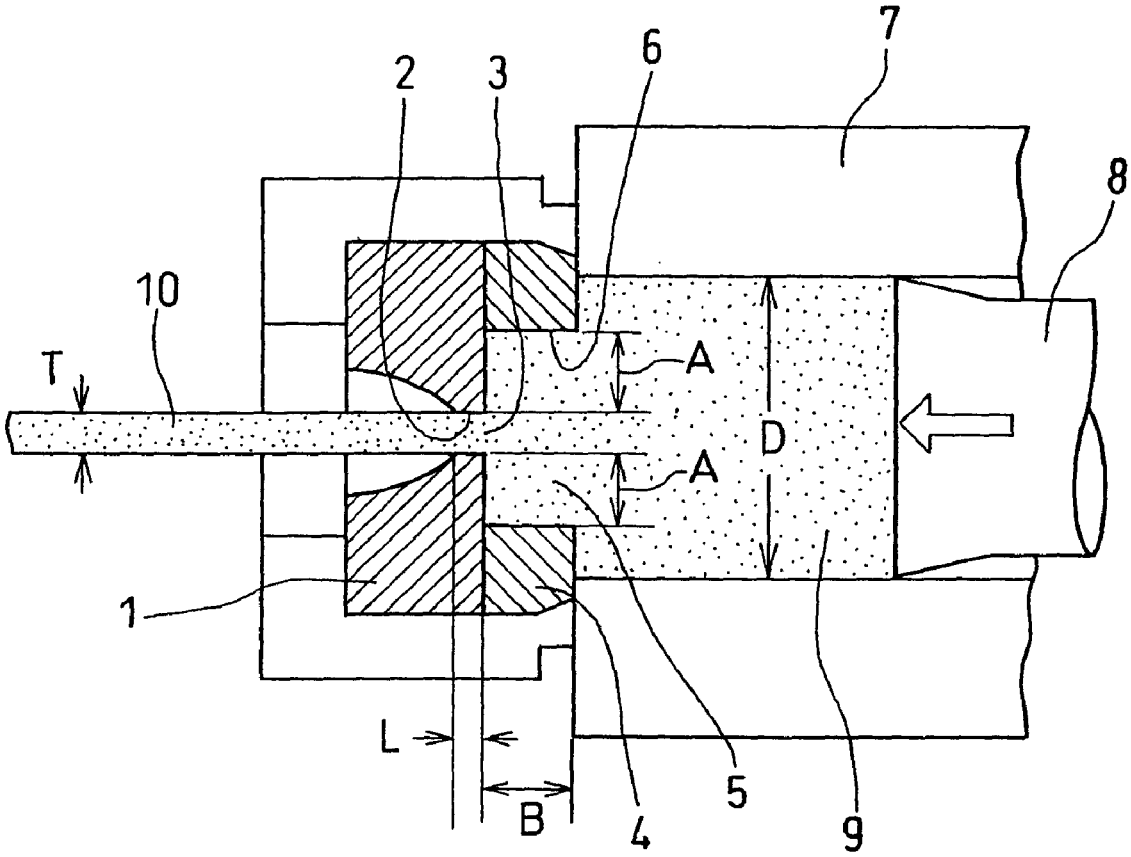
FIG. 1 is a cross-sectional view illustrating a solid die and a flow guide used in the present invention.

The significance and reasons for the limitations of the alloy components of the aluminum alloy of the present invention are described below.

Si plays a role in improving the strength of the aluminum alloy by precipitating $Mg_2Si$ in combination with coexistent Mg. The preferred range for the Si content is 0.5% to 1.5%. If the Si content is less than 0.5%, the improvement effect may be insufficient. If the Si content exceeds 1.5%, the corrosion resistance may decrease. The more preferred range for the Si content is 0.7% to 1.2%.

Mg improves the strength of the aluminum alloy by precipitating $Mg_2Si$ in combination with coexistent Si, and also by precipitating fine particles of $CuMgAl_2$ in combination with coexistent Cu. The preferred range for the Mg content is 0.9% to 1.6%. If the Mg content is less than 0.9%, the improvement in strength may be insufficient. If the Mg content exceeds 1.6%, the corrosion resistance may decrease. The more preferred range for the Mg content is 0.9% to 1.2%.

Cu is an element that contributes to an improvement in strength in the same manner as Si and Mg. The preferred range for the Cu content is 0.8% to 2.5%. If the Cu content is less than 0.8%, the improvement in strength may be insufficient. If the Cu content exceeds 2.5%, it gives rise to a reduced corrosion resistance as well as difficulty in manufacturing. The more preferred range for the Cu content is 0.9% to 2.0%.

Mn plays an important role in providing a high strength by restricting recrystallization during a hot working process and thereby forming a fibrous structure. The preferred range for the Mn content is 0.5% to 1.2%. If the Mn content is less than 0.5%, the effect in restricting the recrystallization may become insufficient. If the Mn content exceeds 1.2%, it gives rise to formation of coarse intermetallic compounds as well as a deterioration in hot workability. The more preferred range for the Mn content is 0.6% to 1.0%.

The high-strength aluminum alloy of the present invention comprises Si, Mg, Cu, and Mn as the essential components, in which the conditional equations (1) to (4) must be satisfied concerning the mutual relationships between the Si, Mg, and Cu contents. This enables the quantity and distribution of intermetallic compounds produced to be adequately controlled to provide an aluminum alloy with a high strength and corrosion resistance in a well-balanced manner. If the combined content of the essential alloying components Si, Mg, and Cu is less than 3.0%, the desired strength cannot be obtained. If the combined content exceeds 4%, the corrosion resistance may decrease. If the combined content of Mg and Si exceeds 2.7%, it gives rise to an inferior corrosion resistance as well as a deterioration in ductility.

Cr, Zr, V, and Zn that may be added to the aluminum alloy of the present invention as optional components reduce the crystal grain size. If the content of Cr, Zr, V, and Zn is less than the lower limit, the above effect may become insufficient. If the content exceeds the upper limit, coarse intermetallic compounds may form, whereby the mechanical characteristics, such as elongation and toughness, of the resulting extruded products may be adversely affected. The aluminum alloy of the present invention may contain a small amount of Ti or B, that is normally added to provide a finer ingot grain structure, without harming the features of the present invention.

Extrusion of a solid product according to the method of the present invention is described below. An aluminum alloy having a given composition is cast into a billet by conventional semi-continuous casting and extruded into a solid product by hot working using a solid die. FIG. 1 illustrates a configuration of equipment used to extrude the solid product. In the case of extruding a long product, a flow guide 4 is provided at the front of a solid die 1 so that successive billets can be used for continuous extrusions.

An aluminum alloy billet 9, charged in an extrusion container 7, is pushed by an extrusion stem 8 in the direction indicated by the arrow in the illustration and forced into an orifice 3 of the solid die 1 after entering a guide hole 5 of the flow guide 4. The aluminum alloy billet 9 is extruded into a solid product 10 as its profile is formed by a bearing face 2 of the solid die 1.

Figure 2:
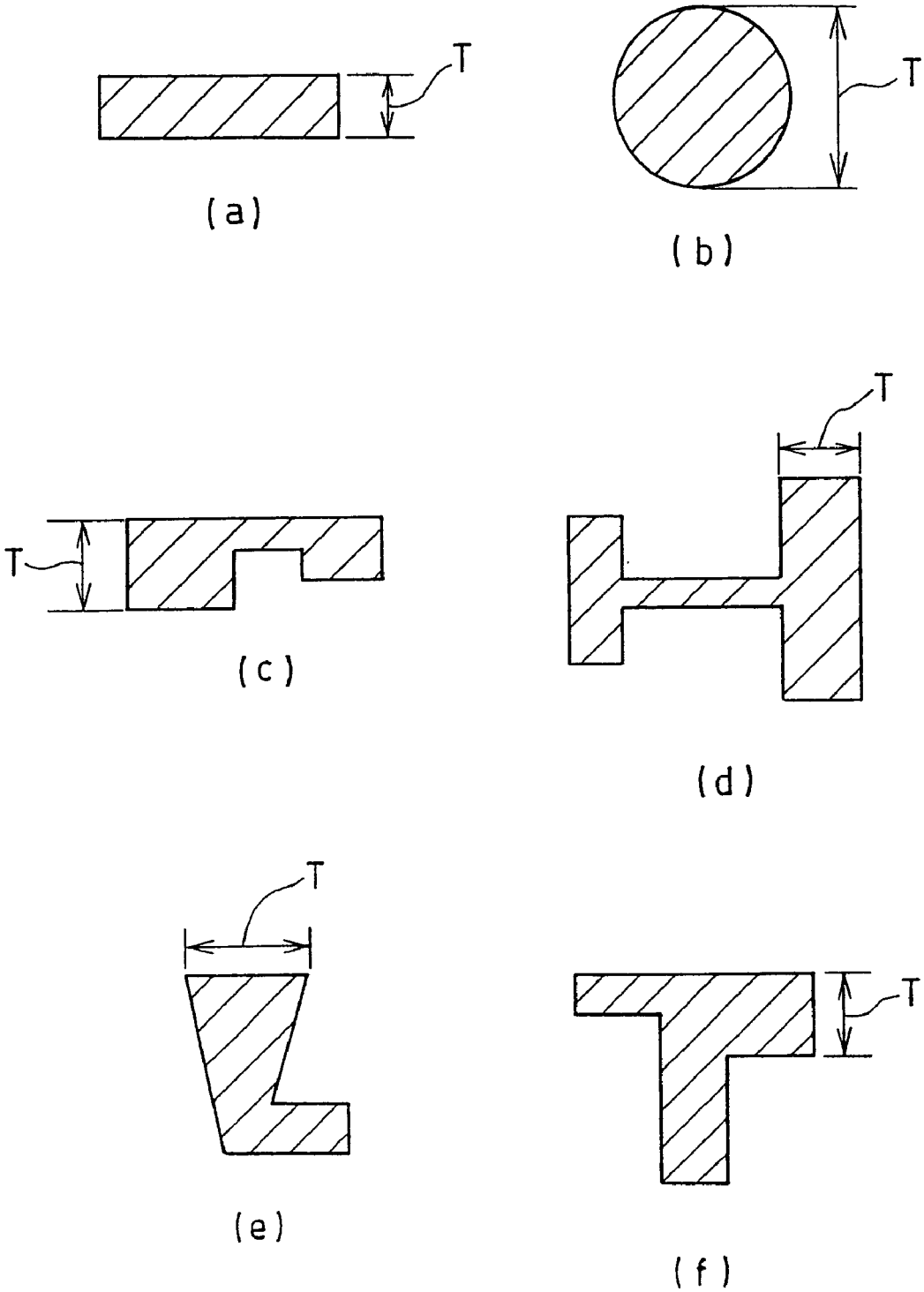
FIGS. 2(*a*)-(*f*) are views illustrating a thickness T of a solid extruded product of the present invention.

In an extrusion procedure for a solid product, the shape of the extruded product is defined by the bearing of the solid die, with the bearing length L having an effect on the characteristics of the extruded product. According to the present invention, it is essential that the bearing length L be set at 0.5 mm or more (i.e. 0.5 mm≦L), and the relationship between the bearing length L and the thickness T as measured for the resulting solid product 10 in the cross-section perpendicular to the extrusion direction (illustrated in FIG. 2) be set at L≦5T, and more preferably at L≦3T. It has been found that by performing the extrusion procedure using a solid die having the dimensions described above, a solid extruded product can be manufactured so that a fibrous structure accounts for 60% or more in area-fraction of the cross-sectional structure of the solid product. A solid extruded product having a fibrous structure at 60% or more, and more preferably 80% or more in area-fraction of the cross-sectional structure excels in strength, corrosion resistance, and stress corrosion cracking resistance. If the area fraction of the recrystallized structure exceeds 20%, it gives rise to a tendency to cause intergranular corrosion. If the area-fraction of the recrystallized structure exceeds 40%, intergranular corrosion exceeding the allowable maximum may occur. The thickness T refers to the largest value of various measurements given for a solid extruded product in the cross-section perpendicular to the extrusion direction, as illustrated in FIG. 2.

If the bearing length is less than 0.5 mm, fabrication of the bearing becomes difficult and elastic deformation of the bearing may give rise to inconsistency in dimensional accuracy. If the bearing length is greater than 5T, recrystallization tends to occur in the surface layer of the cross-sectional structure of the resulting solid product.

In the case where the flow guide 4 needs to be provided at the front of the solid die 1, it is essential that an inner circumferential surface 6 of a guide hole 5 inside the flow guide 4 be separated from the outer circumferential surface of an orifice 3 of the solid die 1 at a distance of 5 mm or more (i.e. A≦5 mm), and the length B of the flow guide 4 be 5% to 25% of the diameter of the billet 9 (i.e. B=D×5% to 25%). Applying the above-described flow guide in combination with a solid die having the above-described bearing dimensions ensures that a fibrous structure accounts for 60% or more in an area-fraction of the cross-sectional structure of the resulting solid product to provide a solid extruded product excelling in strength, corrosion resistance, and stress corrosion cracking resistance.

If the distance A between the inner circumferential surface 6 of the guide hole 5 inside the flow guide 4 and the outer circumferential surface of the orifice 3 of the solid die 1 is less than 5 mm, the degree of working inside the guide hole 5 becomes excessively high, thereby causing recrystallization to occur in the surface layer of the resulting solid product. If the length B of the flow guide 4 is less than 5% of the diameter D of the billet 9, the flow guide 4 may have insufficient strength and therefore a tendency to deform. If the length B of the flow guide 4 is greater than 25% of the diameter D of the billet 9, the degree of working inside the guide hole 5 becomes excessively high, thereby producing cracking in the resulting solid product to cause the strength or elongation to substantially deteriorate. Additionally, for a solid extruded product having a rectangular profile, cracking at the corners or recrystallization in the surface layer can be avoided by rounding off the corners at a radius of 0.5 mm or more.

Figure 3:
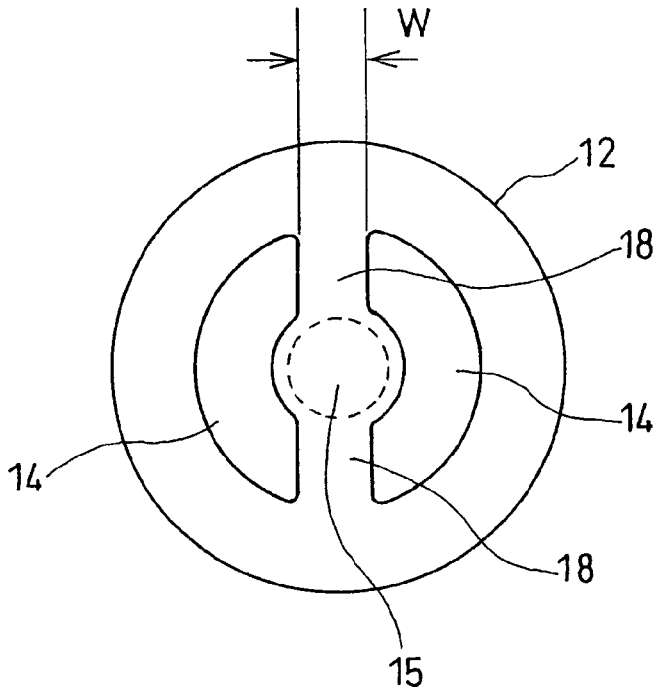
FIG. 3 is a front view illustrating a male die section of a porthole die used in the present invention.
Figure 4:
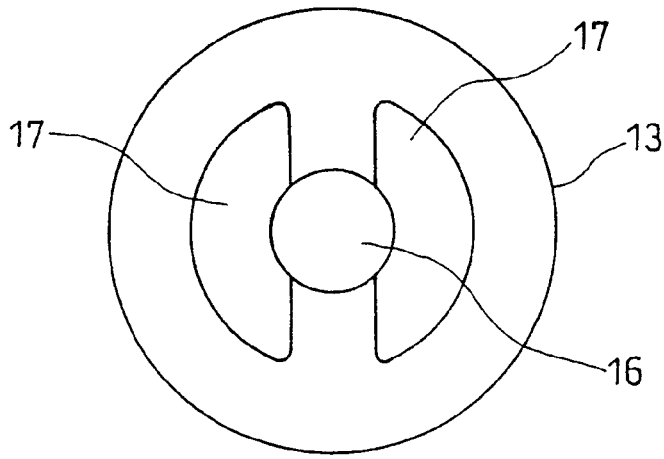
FIG. 4 is a back view illustrating a female die section of a porthole die used in the present invention.
Figure 5:
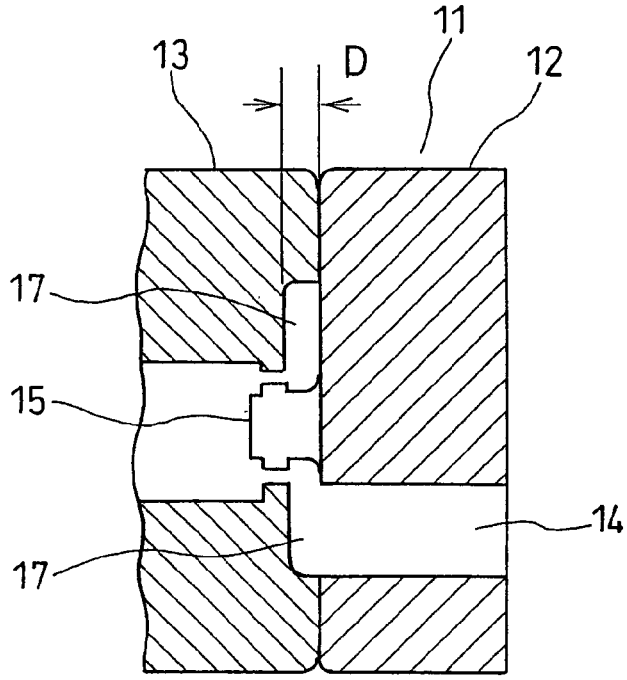
FIG. 5 is a vertical cross-sectional view illustrating a porthole die built by coupling the male die section shown in FIG. 3 and the female die section shown in FIG. 4 together.
Figure 6:
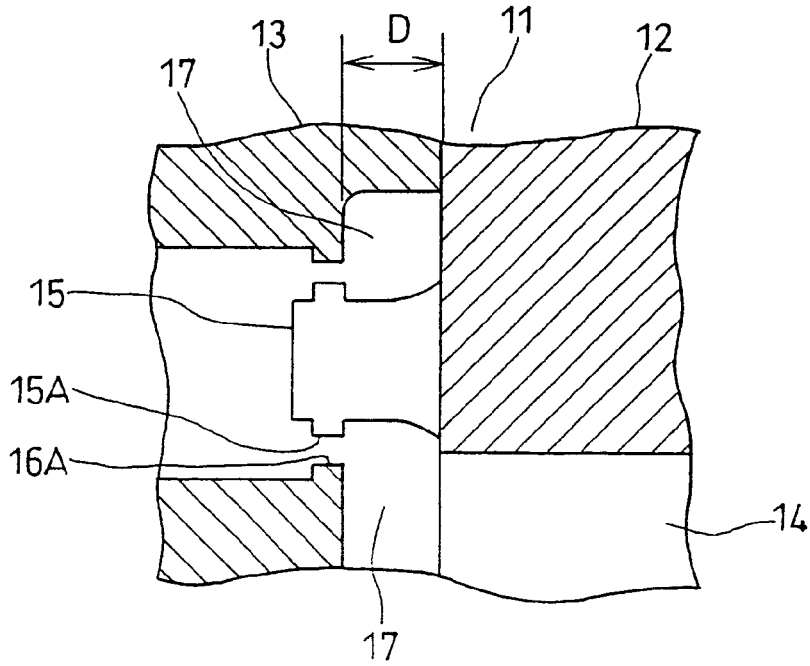
FIG. 6 is an enlarged view of a forming section of the porthole die shown in FIG. 5.

Extrusion of a hollow product according to the method of the present invention is described below. An aluminum alloy having a given composition is cast into a billet by conventional semi-continuous casting and extruded into a hollow product by hot working using a porthole die or a bridge die. FIGS. 3 and 4 illustrate a configuration of a porthole die. FIG. 3 is a front view of a male die section 12 observed from a mandrel 15. FIG. 4 is a back view of a female die section 13 equipped with a die section 16 to house the mandrel 15. FIG. 5 is a vertical cross-sectional view of a porthole die 11 formed by coupling the male die section 12 and the female die section 13 together. FIG. 6 is an enlarged view of a forming section shown in FIG. 5.

The porthole die 11 comprises the male die section 12 equipped with a plurality of port sections 14 and the mandrel 15, and the female die section 13 equipped with the die section 16, which are coupled together as shown in FIG. 5. A billet pushed by an extrusion stem (not shown) enters the port sections 14 of the male die section 12 in divided flows which then reunite (join together) in a chamber 17 while encircling the mandrel 15 in the chamber 17. Upon exiting from the chamber 17, the billet receives forming work by a bearing section 15A of the mandrel 15 for its inner surface and by a bearing section 16A of the die section 16 for its outer surface to produce a hollow product. A bridge die basically has a configuration similar to that of the porthole die except its male die section is modified in consideration of the metal flow within the die, extrusion pressure, extrudability, and the like.

In this case, the aluminum alloy (metal) after entering and exiting the port sections 14 moves into the chamber 17 where the aluminum alloy also flows around the back of bridge sections 18 located between the two port sections 14 to reunite (join). It is observed here that the flow speed of the metal in the non-joining section, where the metal flows from one port section 14 directly out to the die section 16 without engaging in the joining action with the metal flow from another port section 14, is greater than the flow speed of the metal in the joining section, where the metal that exited from one port section 14 flows around the back of the bridge section 18 and engages in the welding action with the metal flow from another port section 14, thereby resulting in a difference in the metal flow speeds inside the chamber 17. It should be noted here that, while FIG. 3 and FIG. 4 illustrate a porthole die having two port sections and two bridge sections, the above-mentioned observation applies equally to a porthole die having three or more port sections and three or more bridge sections.

As a result of extensive experiments and investigations conducted on the relationship between the difference in the metal flow speeds inside the die and the characteristics of the extruded hollow product, the present inventors have found that extrusion cracking and the growth of a coarse grain structure at the joints are caused by the above-described difference in metal flow speeds, and that it is essential to perform the extrusion while restricting the ratio of the metal flow speed in the non-joining section to the metal flow speed in the joining section of the chamber 17 at 1.5 or less (i.e. (flow speeding non-joining section)/(flow speed in joining section) ≦1.5) in order to prevent these problems. Maintaining the ratio of metal flow speeds within the above limits ensures that a fibrous structure accounts for 60% or more in an area-fraction of the cross-sectional structure of the resulting solid product to provide a solid extruded product excelling in strength, corrosion resistance, and stress corrosion cracking resistance. A solid extruded product having a fibrous structure at 60% or more in the area-fraction of the cross-sectional structure excels in strength, corrosion resistance, and stress corrosion cracking resistance. If the area-fraction of the recrystallized structure exceeds 20%, it gives rise to a tendency to cause intergranular corrosion. If the area-fraction of the recrystallized structure exceeds 40%, intergranular corrosion exceeding the allowable maximum may occur.

Figure 7:
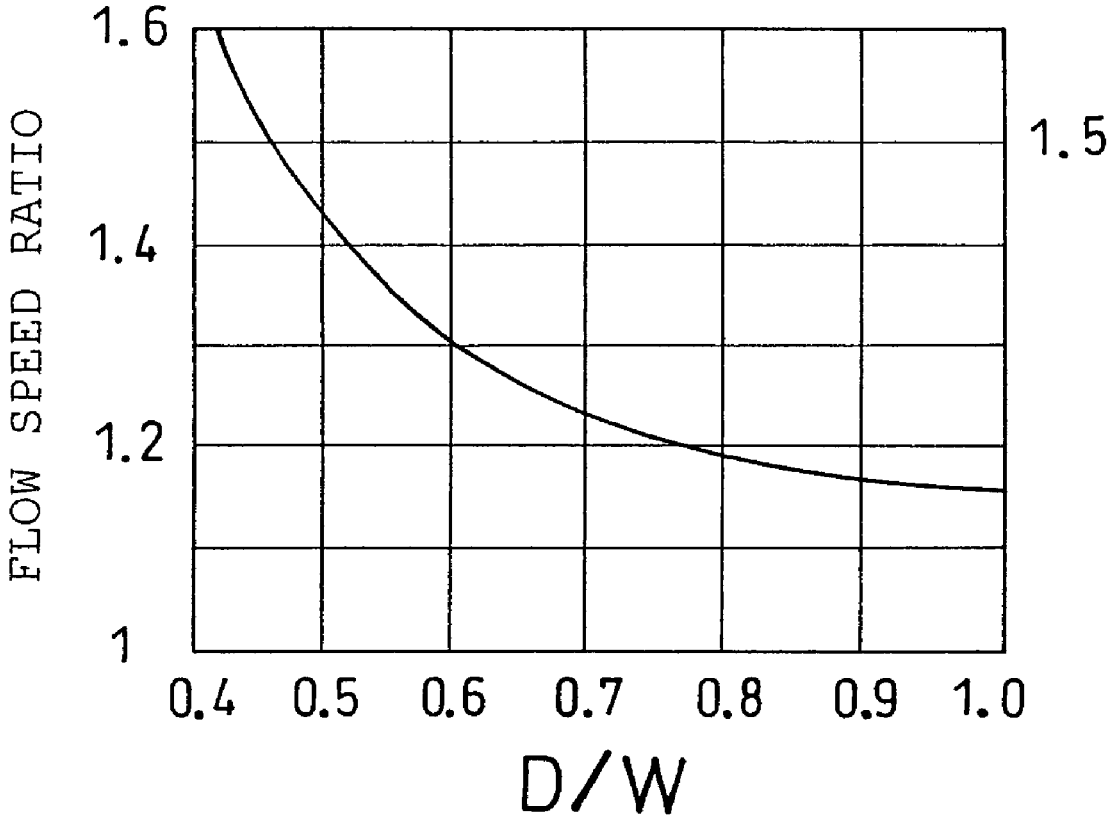
FIG. 7 is a graph illustrating a relationship between a ratio of a chamber depth D to a bridge width W of a porthole die and a ratio of metal flow speeds in the die.

In order to perform extrusion work while restricting the ratio of the metal flow speed in the non-joining section to the metal flow speed in the joining section of the chamber 17 to 1.5 or less, a porthole die designed in such a way that the ratio of the chamber depth D (illustrated in FIGS. 5 and 6) to the bridge width W (illustrated in FIG. 3) is adequately adjusted is used, for example. FIG. 7 illustrates an example of relationships between the D/W ratio and the ratio of the flow speed in the non-joining section to the flow speed in the joining section.

A preferred method of manufacturing the aluminum alloy extruded product of the present invention is described below. A molten aluminum alloy having the above composition is cast into a billet by semi-continuous casting, for example. The resulting billet is homogenized at a temperature not lower than 450° C. but below its melting point, and cooled at an average cooling rate of 25° C./h or more from the homogenization temperature to at least 250° C.

If the homogenization temperature is less than 450° C., a sufficient homogenization effect may not be obtained and dissolution of solute elements becomes inadequate, thereby making it difficult to impart sufficient strength to the product when press quenching, in which the extruded product is water-cooled immediately after extrusion, is performed to obtain the desired strength. By cooling the material to 250° C. at an average cooling rate of 25° C./h or more, solute elements dissolved by the homogenization treatment are kept in the solid solution state to achieve a superior strength. If the cooling rate is less than 25° C./h, solute elements dissolved by the homogenization step may precipitate and coagulate to form coarse grains, thereby making it difficult to impart sufficient strength to the product, since such elements, once coagulated, are hard to redissolve in the solid solution. The more preferred cooling rate is 100° C./h or more to consistently achieve the desired strength.

After completion of the homogenization step, the extrusion billet is extruded by a hot working step by heating the billet to 450° C. or more to obtain an extruded product. If the temperature of the extrusion billet before extrusion is less than 450° C., dissolution of the solute elements may become insufficient, thereby making it difficult to impart sufficient strength to the product by press quenching. If the temperature of the extrusion billet before extrusion exceeds the melting point thereof, cracking may occur during the extrusion operation.

In the case where press quenching is performed, the surface temperature of the extruded product immediately after extrusion is maintained at 450° C. or more and cooled to a temperature of 100° C. or less at a cooling rate of 10° C./sec or more in the press quenching step. If the surface temperature of the extruded product is less than 450° C., a quenching delay in which solute elements precipitate may occur, thereby making it impossible to obtain the desired strength. If the cooling rate is less than 10° C./sec, precipitation of solute elements occurs during the cooling step to make it impossible to obtain the desired strength and to cause the corrosion resistance to deteriorate. The more preferred cooling rate is 50° C./sec or more.

The extruded product may be treated according to a conventional quenching procedure in which the extruded product is subjected to a solution heat treatment at a temperature of 450° C. or more in a heat treatment furnace, such as a controlled-atmosphere furnace or a salt-bath furnace, and cooled to a temperature of 100° C. or less at a cooling rate of 10° C./sec or more. If the heating temperature during the solution heat treatment is less than 450° C. dissolution of solute elements becomes inadequate to make it impossible to obtain the desired strength. If the cooling rate is less than 10° C./sec, precipitation of solute elements occurs during the cooling step in the same manner as in press quenching, thereby making it impossible to obtain the desired strength and causing the corrosion resistance to deteriorate. The more preferred cooling rate is 50° C./sec or more.

The quenched extruded product is annealed at a temperature of 150° C. to 200° C. for 2 to 24 hours to obtain a finished product. If the annealing temperature is less than 150° C., the annealing process may take more than 24 hours in order to obtain sufficient strength, thereby making it undesirable from the standpoint of industrial productivity. If the annealing temperature exceeds 200° C., the maximum achievable strength may become lower. Moreover, if the duration of annealing is less than 2 hours, it is impossible to obtain sufficient strength, whereas an annealing duration of over 24 hours causes the strength to deteriorate.

EXAMPLES

The present invention is described below by comparing examples with comparative examples. However, the present invention is not limited to these examples, which merely are embodiments of the present invention.

Example 1

Aluminum alloys having compositions shown in Table 1 were cast by semi-continuous casting to prepare billets with a diameter of 100 mm. The billets were homogenized at 530° C. for 8 hours, and cooled from 530° C. to 250° C. at an average cooling rate of 250° C./h to prepare extrusion billets.

The extrusion billets were heated to 520° C. and extruded by using a solid die at an extrusion ratio of 27 and an extrusion speed of 6 m/min to obtain solid extruded products having a rectangular profile of 12 mm thickness by 24 mm width. The solid die had a bearing length of 6 mm and the corners of its orifice were rounded off with a radius of 0.5 mm. A flow guide attached to the die had a rectangular guide hole with a distance (A) from the inner circumferential surface of the guide hole to the outer circumferential surface of the orifice set at 15 mm, and a thickness (B) of the flow guide set at 15 mm with respect to the billet diameter of 100 mm (i.e. B=15% of the billet diameter).

The solid extruded products thus obtained were subjected to a solution heat treatment at 540° C., and within 10 seconds of its completion, to a water quenching treatment. 3 days after completion of the quenching, an artificial ageing (annealing) was provided at 175° C. for 8 hours to refine the quenched products to T6 temper. Properties of the T6 materials were evaluated by (1) a measurement of the area ratio of a fibrous structure in the transverse cross section, (2) a tensile test, (3) an intergranular corrosion test, and (4) a stress corrosion cracking test in accordance with the test procedures described below. The evaluation results are summarized in Table 2.

(1) Measurement of area fraction of fibrous structure: The area of a fibrous structure in the transverse cross section was measured by using image analysis equipment and its ratio (%) to the total area was calculated.

(2) Tensile test: Each specimen was tested in accordance with JIS Z2241 for ultimate tensile strength (UTS), yield strength (YS), and fracture elongation (δ).

(3) Intergranular corrosion test: A test solution was prepared by dissolving 57 grams of sodium chloride (NaCl) and 10 ml of 30% aqueous hydrogen peroxide ($H_2O_2$) into distilled water to make a total of 1 liter solution. Each specimen was immersed in the test solution at 30° C. for 6 hours, and the corrosion weight loss was measured. A specimen showing a weight loss of less than 1.0% was judged as having good corrosion resistance.

(4) Stress corrosion cracking test: Based on the test specified in JIS H8711 using a C-ring test piece (28 mm in diameter, 2.2 mm in thickness), the time to fracture at a stress of 350 MPa was measured. A specimen showing no cracking at 700 hours was judged as having good stress corrosion cracking resistance.

TABLE 1

| Alloy | Composition (wt %) | | | | | |
|---|---|---|---|---|---|---|
| | Si | Mg | Cu | Mn | Cr | Other |
| A | 0.9 | 1.1 | 1.8 | 0.9 | 0.2 | — |
| B | 0.9 | 1.1 | 1.8 | 0.6 | 0.2 | — |
| C | 0.9 | 1.1 | 1.8 | 1.2 | 0.2 | — |
| D | 1.2 | 1.0 | 1.8 | 0.9 | 0.2 | — |
| E | 0.8 | 1.3 | 1.7 | 0.9 | 0.2 | — |
| F | 0.8 | 1.0 | 2.0 | 0.9 | 0.2 | — |
| G | 1.1 | 1.0 | 1.0 | 1.0 | 0.2 | — |
| H | 0.9 | 1.1 | 1.8 | 0.9 | 0 | Zr 0.1 |
| I | 0.9 | 1.1 | 1.8 | 0.9 | 0.2 | V 0.1 |
| J | 0.9 | 1.1 | 1.8 | 0.9 | 0.3 | Zn 0.5 |

As shown in Table 2, all of the Specimens No. 1 to No. 10 according to the present invention demonstrated high strength, excellent corrosion resistance, and excellent stress corrosion cracking resistance.

Comparative Example 1

Aluminum alloys having compositions shown in Table 3 were cast by semi-continuous casting to prepare billets with a diameter of 100 mm. The billets were treated according to the same procedures as in Example 1 to prepare extrusion billets. The extrusion billets were heated to 520° C. and extruded under the identical conditions as in Example 1 and using the same solid die and flow guide as in Example 1, to obtain solid extruded products having a rectangular profile. The solid extruded products were treated according to the same procedures as in Example 1 to refine the products to T6 temper.

Properties of the T6 materials were evaluated in the same manner as in Example 1 by (1) the measurement of the area fraction of fibrous structure in the transverse cross section, (2) the tensile test, (3) the intergranular corrosion test, and (4) the stress corrosion cracking test. The evaluation results are summarized in Table 4. In Tables 3 and 4, values and test results that fall outside of the ranges specified in the present invention are underscored.

TABLE 3

| Alloy | Composition (wt %) | | | | |
|---|---|---|---|---|---|
| | Si | Mg | Cu | Mn | Cr |
| K | 0.9 | 1.1 | 1.8 | 0.2 | 0.2 |
| L | 0.9 | 1.1 | 1.8 | 2.0 | 0.2 |
| M | 1.5 | 1.1 | 1.8 | 0.8 | 0.2 |
| N | 1.0 | 1.7 | 1.3 | 0.9 | 0.2 |
| O | 0.6 | 1.5 | 1.8 | 0.9 | 0.2 |
| P | 1.5 | 1.3 | 1.0 | 0.8 | 0.2 |
| Q | 1.7 | 0.9 | 1.1 | 0.9 | 0.2 |
| R | 0.6 | 0.9 | 2.6 | 0.8 | 0.2 |

<Notes>

Alloy M does not satisfy the range specified for Si % + Mg % + Cu %.

Alloy O does not satisfy Mg % ≦1.7 × Si %.

Alloy P does not satisfy the range specified for Mg % + Si %.

TABLE 2

| Specimen | Alloy | Area fraction of fibrous structure (%) | Tensile strength (MPa) | Yield strength (MPa) | Elongation (%) | Corrosion weight loss (%) | Stress corrosion cracking time (h) |
|---|---|---|---|---|---|---|---|
| 1 | A | 92 | 468 | 423 | 13 | 0.2 | >700 |
| 2 | B | 88 | 460 | 420 | 15 | 0.3 | >700 |
| 3 | C | 92 | 475 | 423 | 13 | 0.2 | >700 |
| 4 | D | 91 | 476 | 423 | 14 | 0.3 | >700 |
| 5 | E | 91 | 470 | 416 | 21 | 0.2 | >700 |
| 6 | F | 95 | 480 | 425 | 15 | 0.2 | >700 |
| 7 | G | 96 | 465 | 413 | 15 | 0.3 | >700 |
| 8 | H | 95 | 468 | 418 | 15 | 0.2 | >700 |
| 9 | I | 90 | 478 | 422 | 13 | 0.3 | >700 |
| 10 | J | 91 | 470 | 419 | 16 | 0.3 | >700 |

TABLE 4

| Specimen | Alloy | Area fraction of fibrous structure (%) | Tensile strength (MPa) | Yield strength (MPa) | Elongation (%) | Corrosion weight loss (%) | Stress corrosion cracking time (h) |
|---|---|---|---|---|---|---|---|
| 11 | K | 55 | 430 | 367 | 15 | 0.3 | 120 |
| 12 | L | 83 | 440 | 418 | 6 | 0.2 | >700 |
| 13 | M | 86 | 478 | 420 | 15 | 1.7 | >700 |
| 14 | N | 83 | 480 | 420 | 14 | 1.3 | >700 |
| 15 | O | 84 | 431 | 365 | 14 | 1.2 | >700 |
| 16 | P | 84 | 429 | 419 | 7 | 1.2 | >700 |
| 17 | Q | 83 | 419 | 405 | 6 | 1.2 | >700 |
| 18 | R | 84 | 468 | 410 | 16 | 1.8 | >700 |

As shown in Table 4, Specimen No. 11 developed recrystallization during the extrusion and exhibited reduced strength due to a low Mn content. Specimen No. 11 also produced stress corrosion cracking at 120 hours into the test. Specimen No. 12 developed coarse intermetallic compounds due to the existence of excessive Mn, which resulted in a decreased elongation. Specimen No. 13 exhibited poor corrosion resistance since the composition does not fall into the range specified for the total content of Si %+Mg %+Cu %. Specimens No. 14 and No. 15 showed poor corrosion resistance since the compositions failed to satisfy the range specified for Mg and Mg %≦1.7×Si %, respectively. Specimens No. 16 and No. 17 exhibited poor corrosion resistance and elongation since the compositions failed to satisfy the range specified in the present invention for the total content of Mg and Si and the Si content, respectively. Specimen No. 18 showed poor corrosion resistance due to a high Cu content.

Example 2

The aluminum alloy A having the composition shown in Table 1 was cast by semi-continuous casting to prepare billets with a diameter of 100 mm. The billets were heated under varying conditions shown in Table 5, and extruded by using solid dies having varying bearing lengths as shown in Table 5, without providing a flow guide, and under varying extrusion temperatures as shown in Table 5, to produce solid extruded products having a rectangular profile of 12 mm thickness by 24 mm width.

The solid extruded products were treated by press quenching or quenching under conditions shown in Table 5, and aged artificially under the same aging conditions as in Example 1 to refine the products to T6 temper. In Table 5, the cooling rate after homogenization refers to the average cooling rate from the homogenization temperature to 250° C., the cooling rate for the press quenching refers to the average cooling rate from the material temperature just before the water cooling to 100° C., and the cooling rate for the quenching refers to the average cooling rate from the solution heat treatment temperature to 100° C. A controlled atmosphere furnace was used for the solution heat treatment.

Properties of the T6 materials thus obtained were evaluated in the same manner as in Example 1 by (1) the measurement of the area fraction of fibrous structure in the transverse cross section, (2) the tensile test, (3) the intergranular corrosion test, and (4) the stress corrosion cracking test. The evaluation results are summarized in Table 6.

Comparative Example 2

The aluminum alloy A having the composition shown in Table 1 was cast by semi-continuous casting to prepare billets with a diameter of 100 mm. The billets were heated under varying conditions shown in Table 5, and extruded by using solid dies to produce solid extruded products having a rectangular profile. The solid dies used in the extrusion were respectively provided with bearing lengths of 6 mm for Specimens No. 29 to No. 32 and No. 35, 0.4 mm for Specimen No. 33, and 65 mm for Specimen No. 34, without a flow guide for Specimens No. 29 to No. 34 but using one for Specimens No. 35 and No. 36.

The solid extruded products were treated by press quenching or quenching under conditions shown in Table 5, and annealed under the same annealing conditions as in Example 1 to refine the products to T6 temper. In Table 5, the cooling rate after the homogenization refers to the average cooling rate from the homogenization temperature to 250° C., the cooling rate for the press quenching refers to the average cooling rate from the material temperature just before the water cooling to 100° C., and the cooling rate for the quenching refers to the average cooling rate from the solution heat treatment temperature to 100° C. A controlled atmosphere furnace was used for the solution heat treatment.

Properties of the T6 materials thus obtained were evaluated in the same manner as in Example 1 by (1) the measurement of the area fraction of fibrous structure in the transverse cross section, (2) the tensile test, (3) the intergranular corrosion test, and (4) the stress corrosion cracking test. The evaluation results are shown in Table 6. In Table 5, values and test results that fall outside of the conditions specified in the present invention are underscored.

TABLE 5

| Treatment | Homogenization temperature (° C.) | Cooling rate after homogenization (° C./h) | Extrusion temperature (° C.) | Die bearing length (mm) | Press quenching: Temperature before water cooling (° C.) | Press quenching: Cooling rate (° C./sec) | Quenching: Temperature (° C.) | Quenching: Cooling rate (° C./sec) |
|---|---|---|---|---|---|---|---|---|
| a1 | 530 | 250 | 520 | 6 | 540 | 100 | — | — |
| b1 | 500 | 250 | 520 | 7 | 540 | 100 | — | — |
| c1 | 500 | 100 | 520 | 5 | 540 | 100 | — | — |
| d1 | 500 | 250 | 500 | 6 | 500 | 100 | — | — |
| e1 | 500 | 250 | 520 | 8 | 480 | 100 | — | — |
| f1 | 500 | 250 | 520 | 7 | 540 | 50 | — | — |
| g1 | 530 | 250 | 520 | 6 | 540 | 100 | — | — |
| h1 | 530 | 250 | 520 | 8 | *1 | 0.1 | 540 | 100 |
| i1 | 530 | 250 | 520 | 10 | *1 | 0.1 | 540 | 50 |
| j1 | 530 | 250 | 520 | 50 | *1 | 0.1 | 540 | 50 |
| k1 | 530 | 10 | 520 | 6 | 540 | 100 | — | — |
| l1 | 530 | 250 | 430 | 6 | 540 | 100 | — | — |
| m1 | 530 | 250 | 520 | 6 | 540 | 5 | — | — |
| n1 | 530 | 250 | 520 | 6 | *1 | 0.1 | 540 | 5 |
| o1 | 530 | 250 | 520 | 0.4 | 540 | 100 | — | — |
| p1 | 530 | 250 | 520 | 65 | 540 | 100 | — | — |

*1 Without water cooling

TABLE 6

| Specimen | Treatment | Area fraction of fibrous structure (%) | Tensile strength (MPa) | Yield strength (MPa) | Elongation (%) | Corrosion weight loss (%) | Stress corrosion cracking time (h) | Remarks |
|---|---|---|---|---|---|---|---|---|
| 19 | a1 | 93 | 447 | 415 | 12 | 0.2 | >700 | Single extrusion without flow guide |
| 20 | b1 | 95 | 465 | 420 | 12 | 0.3 | >700 | |
| 21 | c1 | 94 | 459 | 414 | 13 | 0.2 | >700 | |
| 22 | d1 | 94 | 452 | 412 | 12 | 0.3 | >700 | |
| 23 | e1 | 94 | 451 | 413 | 13 | 0.2 | >700 | |
| 24 | f1 | 94 | 461 | 413 | 14 | 0.2 | >700 | |
| 25 | g1 | 95 | 462 | 419 | 12 | 0.3 | >700 | |
| 26 | h1 | 93 | 450 | 415 | 15 | 0.2 | >700 | |
| 27 | i1 | 81 | 448 | 410 | 13 | 0.3 | >700 | |
| 28 | j1 | 70 | 435 | 390 | 11 | 0.7 | >700 | |
| 29 | k1 | 86 | 395 | 340 | 13 | 1.4 | >700 | |
| 30 | l1 | 86 | 380 | 334 | 14 | 1.5 | >700 | |
| 31 | m1 | 87 | 360 | 322 | 14 | 1.5 | >700 | |
| 32 | n1 | 87 | 360 | 300 | 14 | 1.6 | >700 | |
| 33 | o1 | — | — | — | — | — | — | |
| 34 | p1 | 57 | 260 | 150 | 4 | — | — | |
| 35 | g1 | 55 | 265 | 145 | 4 | — | — | Successive extrusions using flow guide A = 4 mm |
| 36 | g1 | 71 | 436 | 392 | 11 | 0.7 | >700 | A = 9 mm |

<Notes>
Extrusion of specimen No. 33 could not be completed due to die bearing breakage.

As shown in Table 6, Specimens No. 19 to No. 28 according to the manufacturing conditions of the present invention demonstrated high strength, excellent corrosion resistance, and excellent stress corrosion cracking resistance. By contrast, Specimens No. 29 to 35 showed defects in either one of the evaluation tests for strength, corrosion resistance, and stress corrosion cracking resistance. Namely, the Specimen No. 29 exhibited insufficient post-quenching strength along with reduced corrosion resistance since the cooling rate after homogenization was low. The Specimen No. 30 showed insufficient strength and decreased corrosion resistance since the low extrusion temperature failed to adequately dissolve solute elements. The Specimen No. 31 showed inferior strength and reduced corrosion resistance due to its low cooling rate during the press quenching. The Specimen No. 32 revealed inadequate strength and low corrosion resistance, resulting from the low cooling rate after the solution heat treatment.

The Specimen No. 33 could not be prepared since the extrusion had to be aborted due to die bearing breakage caused by the short bearing length of the solid die. In the Specimen No. 34, recrystallization occurred in the surface layer due to an increased extrusion temperature since the bearing length of the solid die was long, whereby satisfactory strength could not be obtained. Moreover, since the resulting extruded product developed cracks, the intergranular corrosion test and the stress corrosion cracking test could not be performed.

In the case where a flow guide was used for continuous extrusions with successive feeding of billets, since the Specimen No. 35 was extruded using a flow guide with an insufficient dimension for the distance A, which is the distance between the inner circumferential surface of the guide hole inside the flow guide at the front of the solid die and the outer circumferential surface of the orifice of the solid die, this caused the aluminum alloy billet to be extruded under an excessively high temperature, leading to a recrystallization in the surface layer which prevented the material from obtaining satisfactory strength. Moreover, since the extruded product developed cracks, the intergranular corrosion test and the stress corrosion cracking test could not be performed. By contrast, Specimen No. 36 which used a flow guide with the distance A of 5 mm or more developed only minor recrystallization in the surface layer and showed excellent results for strength, corrosion resistance, and stress corrosion cracking resistance.

Example 3

Aluminum alloys having compositions shown in Table 1 were cast by semi-continuous casting to prepare billets with a diameter of 200 mm. The billets were homogenized at 530° C. for 8 hours, and cooled from 530° C. to 250° C. at an average cooling rate of 250° C./h to prepare extrusion billets. The extrusion billets were extruded (extrusion ratio: 80) at 520° C. into a tubular profile having an outer diameter of 30 mm and an inner diameter of 20 mm using a porthole die designed in such a way that the ratio of the chamber depth D to the bridge width W was 0.5 to 0.6. The ratio of the flow speed of the aluminum alloy in the non-joining section of the chamber to the flow speed of the aluminum alloy in the joining section was 1.2 to 1.4.

The tubular extruded products thus obtained were subjected to a solution heat treatment at 540° C., and within 10 seconds of its completion, to a water quenching treatment. 3 days after completion of the quenching, an artificial ageing (annealing) was provided at 175° C. for 8 hours to refine the products to T6 temper. Properties of the T6 materials were evaluated according to the same test procedures as in Example 1 by (1) the measurement of the area fraction of fibrous structure in the transverse cross section, (2) the tensile test, (3) the intergranular corrosion test, and (4) the stress corrosion cracking test. The evaluation results are summarized in Table 7.

TABLE 7

| Specimen | Alloy | Area fraction of fibrous structure (%) | UTS (MPa) | TS (MPa) | δ (%) | Corrosion weight loss (%) | Stress corrosion cracking time (h) |
|---|---|---|---|---|---|---|---|
| 36 | A | 82 | 458 | 413 | 12 | 0.2 | >700 |
| 37 | B | 85 | 447 | 405 | 13 | 0.3 | >700 |
| 38 | C | 87 | 470 | 418 | 12 | 0.2 | >700 |
| 39 | D | 86 | 470 | 415 | 13 | 0.3 | >700 |
| 40 | E | 86 | 464 | 408 | 20 | 0.2 | >700 |
| 41 | F | 88 | 470 | 420 | 13 | 0.2 | >700 |
| 42 | G | 88 | 445 | 404 | 13 | 0.3 | >700 |
| 43 | H | 88 | 458 | 421 | 12 | 0.2 | >700 |
| 44 | I | 85 | 465 | 415 | 11 | 0.3 | >700 |
| 45 | J | 89 | 464 | 414 | 14 | 0.3 | >700 |

As shown in Table 7, Specimens No. 36 to No. 45 according to the present invention demonstrated a high strength, excellent corrosion resistance, and excellent stress corrosion cracking resistance.

Comparative Example 3

Aluminum alloys having compositions shown in Table 8 were cast by semi-continuous casting to prepare billets with a diameter of 200 mm. The billets were treated according to the same procedures as in Example 3 to prepare extrusion billets. The extrusion billets were heated to 520° C. and extruded under the identical conditions as in Example 1 and using the same porthole die as in Example 3, to obtain tubular extruded products having a tubular profile. The tubular extruded products were treated according to the same procedure as in Example 3 to refine the products to T6 temper. Properties of the TG materials were evaluated in the same manner as in Example 3 by (1) the measurement of the area fraction of the fibrous structure in the transverse cross section, (2) the tensile test, (3) the intergranular corrosion test, and (4) the stress corrosion cracking test. The evaluation results are summarized in Table 9. In Tables 8 and 9, values and test results that fall outside of the ranges specified in the present invention are underscored.

TABLE 8

| | Composition (wt %) | | | | |
|---|---|---|---|---|---|
| Alloy | Si | Mg | Cu | Mn | Cr |
| K | 0.9 | 1.1 | 1.8 | 0.2 | 0.2 |
| L | 0.9 | 1.1 | 1.8 | 2.0 | 0.2 |
| M | 1.5 | 1.1 | 1.8 | 0.8 | 0.2 |
| N | 1.0 | 1.7 | 1.3 | 0.9 | 0.2 |
| O | 0.6 | 1.5 | 1.8 | 0.9 | 0.2 |
| P | 1.5 | 1.3 | 1.0 | 0.8 | 0.2 |
| Q | 1.7 | 0.9 | 1.1 | 0.9 | 0.2 |
| R | 0.6 | 0.9 | 2.6 | 0.8 | 0.2 |

<Notes>
Alloy M does not satisfy the range specified for Si % + Mg % + Cu %.
Alloy O does not satisfy Mg % ≦1.7 × Si %.
Alloy P does not satisfy the range specified for Mg % + Si %.

TABLE 9

| Specimen | Alloy | Area fraction of fibrous structure (%) | UTS (MPa) | TS (MPa) | δ (%) | Corrosion weight loss (%) | Stress corrosion cracking time (h) |
|---|---|---|---|---|---|---|---|
| 46 | K | 50 | 424 | 363 | 15 | 0.8 | 120 |
| 47 | L | 82 | 430 | 415 | 5 | 0.2 | >700 |
| 48 | M | 85 | 470 | 415 | 13 | 1.6 | >700 |
| 49 | N | 81 | 475 | 415 | 12 | 1.2 | >700 |
| 50 | O | 82 | 425 | 360 | 13 | 1.2 | >700 |
| 51 | P | 82 | 420 | 415 | 3 | 1.2 | >700 |
| 52 | Q | 81 | 415 | 400 | 5 | 1.2 | >700 |
| 53 | R | 82 | 460 | 405 | 14 | 1.8 | >700 |

As shown in Table 9, Specimen No. 46 developed recrystallization during the extrusion and exhibited reduced strength due to low Mn content. The Specimen No. 46 also produced stress corrosion cracking at 120 hours into the test. Specimen No. 47 developed coarse intermetallic compounds due to the existence of excessive Mn, which resulted in decreased elongation. Specimen No. 48 exhibited poor corrosion resistance since the composition did not fall into the range specified for the total content of Si %+Mg %+Cu %. Specimens No. 49 and No. 50 showed a poor corrosion resistance since the compositions failed to satisfy the range specified for the Mg content and Mg %≦1.7×Si %, respectively. Specimens No. 51 and No. 52 exhibited poor corrosion resistance and poor elongation since the compositions failed to satisfy the range specified in the present invention for the total content of Mg and Si and the Si content, respectively. Specimen No. 53 showed poor corrosion resistance due to high Cu content.

Example 4

The aluminum alloy A having the composition shown in Table 1 was cast by semi-continuous casting to prepare billets with a diameter of 200 mm. The billets were processed under conditions shown in Table 10 to prepare tubular extruded products. As the extrusion die, the same porthole die as that used in Example 3 was used.

The tubular extruded products were treated by press quenching or quenching under conditions shown in Table 10, and aged artificially under the same aging conditions as in Example 3 to refine the products to T6 temper. In Table 10, the cooling rate after homogenization refers to the average cooling rate from the homogenization temperature to 250° C., the cooling rate for the press quenching refers to the average cooling rate from the material temperature just before the water cooling to 100° C., and the cooling rate for the quenching refers to the average cooling rate from the solution heat treatment temperature to 100° C. A controlled atmosphere furnace was used for the solution heat treatment.

Properties of the T6 materials thus obtained were evaluated in the same manner as in Example 3 by (1) the measurement of the area fraction of fibrous structure in the transverse cross section, (2) the tensile test, (3) the intergranular corrosion test, and (4) the stress corrosion cracking test. The evaluation results are summarized in Table 11.

Comparative Example 4

The aluminum alloy A having the composition shown in Table 1 was cast by semi-continuous casting to prepare billets with a diameter of 200 mm. The billets were treated under conditions shown in Table 10 to obtain tubular extruded products. In treatments No. i2 to No. o2, extrusion was performed using the same porthole die as that used in Example 3. In treatment No. p2, a porthole die in which the ratio of the chamber depth D to the bridge width W was 0.43 (i.e. W/D=0.43) was used.

The tubular extruded products were treated by press quenching or quenching under conditions shown in Table 10, and aged artificially under the same aging conditions as in Example 1 to refine the products to T6 temper.

Properties of the T6 materials thus obtained were evaluated in the same manner as in Example 1 by (1) the measurement of the area fraction of fibrous structure in the transverse cross section, (2) the tensile test, (3) the intergranular corrosion test, and (4) the stress corrosion cracking test. The evaluation results are shown in Table 11. In Tables 10 and 11, values and test results that fall outside of the conditions specified in the present invention are underscored.

TABLE 10

| Treatment | Homogenization temperature (° C.) | Cooling rate after homogenization (° C./h) | Extrusion temperature (° C.) | Press quenching: Temperature before water cooling (° C.) | Press quenching: Cooling rate (° C./sec) | Quenching: Temperature (° C.) | Quenching: Cooling rate (° C./sec) | Flow Speed Ratio |
|---|---|---|---|---|---|---|---|---|
| a2 | 530 | 250 | 520 | 540 | 100 | — | — | 1.2 |
| b2 | 500 | 250 | 520 | 540 | 100 | — | — | 1.3 |
| c2 | 500 | 100 | 520 | 540 | 100 | — | — | 1.2 |
| d2 | 500 | 250 | 520 | 500 | 100 | — | — | 1.3 |
| e2 | 500 | 250 | 520 | 480 | 100 | — | — | 1.4 |
| f2 | 500 | 250 | 520 | 540 | 50 | — | — | 1.3 |
| g2 | 530 | 250 | 520 | 340 | 100 | — | — | 1.2 |
| h2 | 530 | 250 | 520 | 540 | 100 | — | — | 1.3 |

TABLE 10-continued

| Treatment | Homogenization temperature (° C.) | Cooling rate after homogenization (° C./h) | Extrusion temperature (° C.) | Press quenching: Temperature before water cooling (° C.) | Press quenching: Cooling rate (° C./sec) | Quenching: Temperature (° C.) | Quenching: Cooling rate (° C./sec) | Flow Speed Ratio |
|---|---|---|---|---|---|---|---|---|
| i2 | 530 | 250 | 520 | 540 | 100 | — | 100 | 1.2 |
| j2 | 530 | 250 | 520 | *1 | 0.1 | 540 | 50 | 1.2 |
| k2 | 530 | 250 | 520 | *1 | 0.1 | 540 | | 1.3 |
| l2 | 530 | 10 | 520 | 540 | 100 | — | — | 1.3 |
| m2 | 530 | 250 | 430 | 540 | 100 | — | — | 1.2 |
| n2 | 530 | 250 | 520 | 540 | 5 | — | — | 1.4 |
| o2 | 530 | 250 | 520 | *1 | 0.1 | 540 | 5 | 1.2 |
| p2 | 530 | 250 | 520 | 540 | 100 | — | — | 1.6 |

<Notes>
Flow Speed Ratio: The ratio of the flow speed of the aluminum alloy in the non-joining section of the chamber to the flow speed of the aluminum alloy in the joining section.

TABLE 11

| Specimen | Alloy | Area fraction of fibrous structure (%) | UTS (MPa) | TS (MPa) | δ (%) | Corrosion weight loss (%) | Stress corrosion cracking time (h) |
|---|---|---|---|---|---|---|---|
| 54 | a2 | 83 | 448 | 405 | 12 | 0.3 | >700 |
| 55 | b2 | 84 | 455 | 410 | 12 | 0.3 | >700 |
| 56 | c2 | 85 | 452 | 406 | 12 | 0.2 | >700 |
| 57 | d2 | 84 | 445 | 405 | 12 | 0.2 | >700 |
| 58 | e2 | 84 | 442 | 405 | 13 | 0.2 | >700 |
| 59 | f2 | 85 | 450 | 405 | 14 | 0.3 | >700 |
| 60 | g2 | 84 | 458 | 415 | 12 | 0.3 | >700 |
| 61 | h2 | 84 | 435 | 400 | 14 | 0.3 | >700 |
| 62 | i2 | 76 | 455 | 412 | 12 | 0.2 | >700 |
| 63 | j2 | 81 | 447 | 405 | 14 | 0.2 | >700 |
| 64 | k2 | 81 | 438 | 402 | 12 | 0.2 | >700 |
| 65 | l2 | 80 | 393 | 334 | 13 | 1.3 | >700 |
| 66 | m2 | 81 | 376 | 322 | 14 | 1.5 | >700 |
| 67 | n2 | 81 | 354 | 300 | 14 | 1.5 | >700 |
| 68 | o2 | 81 | 350 | 290 | 15 | 1.7 | >700 |
| 69 | p2 | 50 | 280 | 200 | 7 | 5.0 | 500 |

As shown in Table 11, Specimens No. 54 to 64 according to the manufacturing conditions of the present invention demonstrated high strength, excellent corrosion resistance, and excellent stress corrosion cracking resistance. By contrast, Specimens No. 65 to 70 showed defects in either one of the evaluation tests for strength, corrosion resistance, and stress corrosion cracking resistance. Namely, the Specimen No. 65 exhibited insufficient post-quenching strength along with reduced corrosion resistance since the cooling rate after homogenization was not adequately high. Specimen No. 66 showed an insufficient strength and decreased corrosion resistance since the low extrusion temperature failed to achieve sufficient dissolution of the solute elements.

Specimen No. 67 showed an inferior strength and decreased corrosion resistance since the cooling rate was low during the press quenching. Specimen No. 68 revealed an inadequate strength and decreased corrosion resistance, resulting from its low cooling rate after the solution heat treatment. Since Specimen No. 69 was extruded with a die having a high flow speed ratio, the billet was extruded at an excessively high temperature. This gave rise to a growth of a recrystallized grain structure, resulting in an area-fraction of the fibrous structure to the cross-sectional structure of 50%. As a result, the finished product failed to acquire a satisfactory strength and exhibited an intergranular corrosion and high weight loss, whereby cracking occurred at 500 hours into the stress corrosion cracking test.

According to the present invention, a method of manufacturing a high-strength aluminum alloy extruded product excelling in corrosion resistance and stress corrosion cracking resistance can be provided. The aluminum alloy extruded product is suitable for use in applications as structural materials for transportation equipment such as automobiles, railroad carriages, and aircrafts, instead of conventional ferrous materials.

Obviously, numerous modifications and variations of the present invention are possible in light of the above teachings. It is therefore to be understood that, within the scope of the appended claims, the invention may be practiced otherwise than as specifically described herein.

What is claimed is:

1. A method of manufacturing a high-strength aluminum alloy extruded product excelling in corrosion resistance and stress corrosion cracking resistance, the method comprising continuously extruding a billet of an aluminum alloy comprising, hereinafter, all compositional percentages are by weight, 0.5% to 1.5% of Si, 0.9% to 1.6% of Mg, 1.7% to 2.5% of Cu, while satisfying the following equations (1), (2), (3), and (4), $$3 \leqq Si\% + Mg\% + Cu\% \leqq 4 \quad (1)$$

$$Mg\% \leqq 1.7 \times Si\% \quad (2)$$

$$Mg\% + Si\% \leqq 2.7 \quad (3)$$

$$Cu\%/2 \leqq Mg\% \leqq (Cu\%/2) + 0.6 \quad (4)$$

and further comprising 0.5% to 1.2% of Mn, with the balance being Al and unavoidable impurities, into a solid product by using a solid die having a bearing length (L) of 0.5 mm or more and the bearing length (L) and thickness (T) of the solid product to be extruded have a relationship defined by $L \leqq 5T$, to obtain the solid product in which a fibrous structure accounts for 60% or more in area-fraction of the cross sectional structure of the solid product, wherein a flow guide is provided in front of the solid die, an inner circumferential surface of a guide hole of the flow guide being separated from an outer circumferential surface of an orifice which is continuous with the bearing of the solid die at a distance of 5-15 mm, and the thickness of the flow guide being 5% to 25% of the diameter of the billet.

2. The method of manufacturing a high-strength aluminum alloy extruded product excelling in corrosion resistance and stress corrosion cracking resistance according to claim 1, wherein the aluminum alloy further comprises at least one of 0.02% to 0.4% of Cr, 0.03% to 0.2% of Zr, 0.03% to 0.2% of V, and 0.03% to 2.0% of Zn.

3. The method of manufacturing a high-strength aluminum alloy extruded product excelling in corrosion resistance and stress corrosion cracking resistance according to claim 2, the method additionally comprising a homogenization step wherein a billet of the aluminum alloy is homogenized at 450° C. or more and cooled at an average cooling rate of 25° C./h or more from the homogenization temperature to at least 250° C., an extrusion step wherein the homogenized billet of the aluminum alloy is extruded at a temperature of 450° C. or more, a press quenching step wherein the extruded product is cooled to a temperature of 100° C. or less at a cooling rate of 10° C./sec or more in a state in which the surface temperature of the extruded product immediately after the extrusion is maintained at 450° C. or more, or a quenching step wherein the extruded product is subjected to a solution heat treatment at a temperature of 450° C. or more and cooled to a temperature of 100° C. or less at a cooling rate of 10° C./sec or more, and an aging step wherein the quenched product is heated at a temperature of 150° C. to 200° C. for 2 to 24 hours.

4. The method of manufacturing a high-strength aluminum alloy extruded product excelling in corrosion resistance and stress corrosion cracking resistance according to claim 1, the method additionally comprising a homogenization step wherein a billet of the aluminum alloy is homogenized at 450° C. or more and cooled at an average cooling rate of 25° C./h or more from the homogenization temperature to at least 250° C., an extrusion step wherein the homogenized billet of the aluminum alloy is extruded at a temperature of 450° C. or more, a press quenching step wherein the extruded product is cooled to a temperature of 100° C. or less at a cooling rate of 10° C./sec or more in a state in which the surface temperature of the extruded product immediately after the extrusion is maintained at 450° C. or more, or a quenching step wherein the extruded product is subjected to a solution heat treatment at a temperature of 450° C. or more and cooled to a temperature of 100° C. or less at a cooling rate of 10° C./sec or more, and an aging step wherein the quenched product is heated at a temperature of 150° C. to 200° C. for 2 to 24 hours.

5. The method of manufacturing a high-strength aluminum alloy extruded product excelling in corrosion resistance and stress corrosion cracking resistance according to claim 1, wherein the aluminum alloy consists of Al, 0.05-1.5% of Si, 0.9-1.6% of Mg, 1.7-2.5% of Cu, 0.5-1.2% of Mn and, optionally, 0.02-0.4% Cr, 0.03-0.2% Zr, 0.03-0.2% V and 0.03-2.0% Zn.

* * * * *